US007552562B2

(12) United States Patent
Curtis et al.

(10) Patent No.: US 7,552,562 B2
(45) Date of Patent: Jun. 30, 2009

(54) STRUCTURAL FILLER SYSTEM FOR A WINDOW OR DOOR

(75) Inventors: Daniel J. Curtis, Warroad, MN (US); Todd Alan Lund, Roseau, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 658 days.

(21) Appl. No.: 11/127,985

(22) Filed: May 12, 2005

(65) Prior Publication Data

US 2006/0254151 A1 Nov. 16, 2006

(51) Int. Cl.
*E05D 13/00* (2006.01)

(52) U.S. Cl. ..... 49/414; 49/428; 49/433; 49/435; 49/436; 49/454

(58) Field of Classification Search ..... 49/404, 49/428, 440, 431, 433, 434, 435, 436, 414, 49/454

See application file for complete search history.

(56) References Cited

U.S. PATENT DOCUMENTS

| | | | | |
|---|---|---|---|---|
| 926,735 | A | 7/1909 | Gould | |
| 1,038,160 | A | 9/1912 | Leonard | |
| 1,842,242 | A | 1/1932 | Bolles | |
| 2,593,239 | A | 4/1952 | Anderson | |
| 2,595,419 | A | 5/1952 | Smith | |
| 2,843,233 | A | 7/1958 | Walsh | |
| 2,912,077 | A | 11/1959 | Walsh | |
| 2,943,345 | A | 7/1960 | Ammerman | |
| 3,145,433 | A * | 8/1964 | Jones | 49/414 |
| 3,676,956 | A | 7/1972 | Taylor et al. | |
| 3,717,887 | A | 2/1973 | Thomas | |
| 3,724,136 | A | 4/1973 | Forsberg | |
| 4,300,316 | A | 11/1981 | Ficurilli | |

(Continued)

FOREIGN PATENT DOCUMENTS

| | | |
|---|---|---|
| AU | 0220004 | 5/1958 |

(Continued)

OTHER PUBLICATIONS

U.S. Appl. No. 11/127,906, Preliminary Amendment mailed Jun. 26, 2008, 10 pgs.

(Continued)

*Primary Examiner*—Katherine W Mitchell
*Assistant Examiner*—Catherine A Kelly
(74) *Attorney, Agent, or Firm*—Schwegman, Lundberg & Woessner, P.A.

(57) ABSTRACT

A window or door assembly including a jamb member and a jamb liner having a fastener opening coupled along the jamb member. A sash is moveably coupled along the jamb liner. The window or door assembly includes a structural filler coupled over a portion of the jamb liner, and the structural filler substantially conceals the fastener opening. The structural filler includes a flange sized and shaped to engage with the sash, and the flange substantially prevents movement of the sash over the structural filler. In one option, the flange extends along the structural filler and the sash. The structural filler further includes a contact surface engaged with the jamb liner and a projection rotatably coupled with the jamb liner, and the structural filler rotates in a first direction around the projection.

27 Claims, 9 Drawing Sheets

U.S. PATENT DOCUMENTS 4,441,277 A 4/1984 Naylor
4,551,881 A 11/1985 Hoffman
4,570,382 A 2/1986 Suess
4,583,639 A 4/1986 Fedick et al.
4,606,147 A 8/1986 DeWitt et al.
4,685,175 A 8/1987 Yonovich
4,719,729 A 1/1988 Wynar
4,726,148 A 2/1988 Tix
4,763,447 A 8/1988 Haltof et al.
4,799,333 A 1/1989 Westfall et al.
4,885,871 A 12/1989 Westfall et al.
4,891,921 A 1/1990 Governale
4,914,861 A 4/1990 May
4,922,657 A 5/1990 Foss
5,012,554 A 5/1991 Dense
5,027,557 A 7/1991 May
5,033,235 A 7/1991 Stark
5,036,622 A 8/1991 Stark
5,038,538 A 8/1991 Rozon
5,099,624 A * 3/1992 Valentin ..... 52/207
5,117,586 A 6/1992 Stark
5,174,064 A 12/1992 Stark
5,199,219 A 4/1993 Martini et al.
5,224,298 A 7/1993 Horst
5,231,795 A 8/1993 Westfall
5,265,308 A 11/1993 May et al.
5,293,723 A 3/1994 Slessor
5,414,962 A 5/1995 Forbis et al.
5,448,857 A 9/1995 Stormo
5,515,652 A 5/1996 Klimek
5,526,608 A 6/1996 Stark
5,544,450 A 8/1996 Schmidt et al.
5,546,702 A 8/1996 deNormand et al.
5,566,507 A * 10/1996 Schmidt et al. ..... 49/428
5,632,118 A 5/1997 Stark
5,671,566 A 9/1997 Tix et al.
5,675,937 A 10/1997 Stebel
5,698,944 A 12/1997 Togawa
5,699,636 A 12/1997 Start
5,703,720 A 12/1997 Fulco et al.
5,866,054 A 2/1999 Dorchester et al.
5,901,499 A 5/1999 Delaske et al.
5,934,031 A 8/1999 deNormand
5,974,745 A 11/1999 Barr
6,018,916 A 2/2000 Henry
6,026,617 A 2/2000 Stark
6,041,475 A 3/2000 Nidelkoff
6,041,550 A 3/2000 Tix
6,055,782 A 5/2000 Morton et al.
6,112,463 A 9/2000 Reithmeyer et al.
6,119,324 A 9/2000 Suess
6,122,864 A * 9/2000 Martin ..... 49/428
6,141,913 A 11/2000 Wong et al.
6,167,655 B1 1/2001 Santa Cruz et al.
6,279,270 B1 8/2001 Suess
6,282,852 B1 9/2001 Walcker
6,293,061 B1 9/2001 Horak, Jr.
6,305,126 B1 * 10/2001 Hendrickson et al. ..... 49/456
6,308,487 B1 10/2001 Cantley
6,357,200 B1 3/2002 Vanderpan
6,405,501 B1 6/2002 Cerrato
6,470,643 B1 10/2002 Cantley
6,530,190 B2 * 3/2003 Conachen ..... 52/718.04
6,588,150 B1 7/2003 Wong et al.
6,588,159 B1 7/2003 Cotton, Jr.
6,684,571 B2 * 2/2004 Hendrickson et al. ..... 49/428
6,718,693 B2 4/2004 Gleason
6,722,082 B1 * 4/2004 Peterson et al. ..... 49/428
6,883,276 B1 * 4/2005 Hannan et al. ..... 49/428
7,228,660 B2 * 6/2007 Rhode et al. ..... 49/428
7,340,866 B1 3/2008 Smith
7,416,772 B2 8/2008 Rinehart et al.
2003/0024182 A1 2/2003 Yeany
2006/0272234 A1 12/2006 Curtis

FOREIGN PATENT DOCUMENTS

CA 0605391 9/1960

OTHER PUBLICATIONS

U.S. Appl. No. 11/127,906, Response filed Jun. 26, 2008 to Restriction Requirement mailed May 29, 2008, 10 pgs.
U.S. Appl. No. 11/127,906, Restriction Requirement mailed May 29, 2008, 7 pgs.
U.S. Appl. No. 11/127,906, Reestriction Requirement mailed May 12, 2008, 6 pgs.
U.S. Appl. No. 11/127,906, Non-Final Office Action mailed Sep. 15, 2008, 12 pgs.

* cited by examiner

STRUCTURAL FILLER SYSTEM FOR A WINDOW OR DOOR

TECHNICAL FIELD

Structural fillers used with windows and doors and in particular structural fillers that support wind loads and are easily disassembled.

BACKGROUND

Many current window and door assemblies include liners extending along frame members (e.g., jambs, sills and headers) to facilitate movement of window sashes and sliding doors within frames. Frame fasteners (e.g., nails or screws) are driven through the liner and the frame member to couple the window or door assembly with surfaces defining rough openings in a wall. In some examples, fillers are attached over the liner and the frame fasteners to retain a sash or sliding door within a track along the liner. The filler substantially prevents lateral movement of the sash caused by a modest lateral force (e.g., wind). The fillers are coupled to the liner with fasteners, such as nails or screws, driven into the filler and the liner with hammers and/or screwdrivers. The fasteners are sometimes covered with a putty to conceal the fastener.

To remove the sash from the frame, the filler must be removed. Removing the filler is a labor intensive task requiring extensive work with tools. This requires digging through putty (e.g., with a pick) to get at the fastener and can damage the filler. Reinstalling the filler requires installing a replacement filler and/or puttying over the fastener again. In another example, the filler is torn away from the liner to allow for removal of the sash. Tearing out the filler causes damage to the filler and the window or door. Additionally, to remove a window or door from the rough opening (e.g., for service or installation elsewhere), the filler must be removed in a similar manner to expose the frame fasteners. Moreover, inspection of the filler often reveals the putty or fasteners because they have a different color than the rest of the filler and the fastener or the putty is not flush with the surface of the filler. Further, the filler often is made of a material having a different appearance from the rest of the window including, for instance, a wooden frame, decorative trim extending around the frame, and wooden sashes. The putty marks, fasteners and the different appearance of the filler reduce the aesthetic appeal of the window or door.

In other examples, the filler is integral with the frame member. Frame fasteners are driven through the filler and the frame member to couple the window or door assembly with the surface of a rough opening in a wall. Removal of a sash from the frame requires damaging the filler by tearing it away from the frame member. In still other examples, the fillers are at least partially held in place by the sashes and installation and removal of the window or door requires removal of the sashes. Removal thereby requires added labor and time to first remove the sashes and then remove the fillers (e.g., tearing out the fillers or unscrewing them from the liner) to provide access to the frame fasteners. After both the sashes and the fillers are removed to expose the frame fasteners, the frame fasteners are removed and the window or door is removable from a rough opening. Similarly, installation requires removal of the sashes and the fillers to provide access to the portion of the frame used to couple with the surface of the rough opening. Additionally, tools, such as a pick, hammer or screwdriver, are needed to remove the filler from the frame to access the frame fasteners.

What is needed is a structural filler system that overcomes the shortcomings of previous fillers. What is further needed is a structural filler system that provides easy access to frame fasteners while also substantially preventing lateral movement of sashes.

SUMMARY

A window or door assembly including a jamb member (including frame members such as sills and headers in a door assembly) and a jamb liner coupled along the jamb member. The jamb liner includes a fastener opening. In one option, the jamb liner is integral to the jamb member. The window or door assembly includes a sash moveably coupled along the jamb liner. A freely rotating structural filler is coupled over a portion of the jamb liner and the fastener opening. The structural filler includes a flange and the flange substantially prevents movement of the sash over the structural filler. The structural filler further includes a contact surface engaged with the jamb liner and a projection rotatably coupled with the jamb liner, and the structural filler freely rotates in a first direction around the projection.

Several options for the window or door follow assembly. In one option, the structural filler includes at least one flange sized and shaped to engage with the sash. The at least one flange, in another option, extends along the structural filler and the sash. In yet another option, the structural filler and the jamb liner are adapted to transmit at least 3.75 pounds per inch of filler length to the jamb member when the sash is engaged with the structural filler (e.g., engaged along the flange extending along at least a portion of the length of the filler). In still another option, the structural filler and the jamb liner are adapted to transmit at least 6.0 pounds per inch of filler length to the jamb member when the sash is engaged with the structural filler.

Optionally, the structural filler has a substantially uniform outer surface (e.g., flawless) between at least the flange and the contact surface. In one option, the structural filler is extruded. The structural filler includes a first material, and the sash includes the first material, in another option (e.g., the structural filler and the sash have a similar appearance). In still another option, the structural filler includes a first material, and the jamb member includes the first material (e.g., the structural filler and the sash have a similar appearance). In another option, the window or door assembly includes a jamb stop coupled with the jamb member. The jamb stop extends over a portion of the sash, and the jamb stop and the structural filler cooperate to retain the sash therebetween. A cladding is coupled with the jamb member, in yet another option. The cladding extends over a portion of the sash, and the cladding and the structural filler cooperate to retain the sash therebetween.

A method for making a window or door assembly includes coupling a jamb liner along an elongated jamb member, and the jamb liner includes a fastener opening. A sash is moveably coupled along the jamb liner. The method further includes coupling a structural filler over a portion of the jamb liner, and the structural filler freely rotates relative to the jamb liner and uncouples therefrom when the structural filler is rotated in a first direction. Lateral movement of the sash is substantially prevented when the sash engages against the structural filler. The method further includes concealing the fastener opening with the structural filler.

Several options for the method follow. In one option, the method includes coupling the jamb member with a surface defining a rough opening after moveably coupling the sash along the jamb liner (i.e., the sash is preinstalled to provide a nearly complete window or door assembly prior to installation). In another option, coupling the structural filler with the jamb liner occurs after moveably coupling the sash with the jamb liner (i.e., access is available to one or more fastener openings for installation of the nearly assembled window or door assembly).

In yet another option, a fastener is passed through the fastener opening to couple the jamb member with the surface defining the rough opening. Optionally, the structural filler conceals the fastener. The method includes, in still another option, transmitting a force from the sash to the structural filler when the sash engages against the structural filler. The force is transmitted from the structural filler to the jamb liner and from the jamb liner to the jamb member.

Optionally, coupling the structural filler over the portion of the jamb liner includes coupling the structural filler substantially without tools (e.g., the structural filler is coupled to the jamb liner with pressure applied by hand). The method further includes, in another option, rotating the structural filler in the first direction and uncoupling the structural filler from the jamb liner without tools (e.g., the structural filler is rotated by hand).

The above described structural filler system provides a load bearing filler that facilitates easy access to jamb member fastener openings and fasteners therein without requiring removal of the sash member (or a sliding door) from the jamb member (including frame members, such as sill and header members). The structural filler couples with the jamb liner to permit free rotation of the structural filler (e.g., with pressure applied by hand and without tools) when rotated in a first direction. The structural filler is thereby easily disengaged from the jamb liner to expose fasteners and fastener features and allow for installation and removal of the window or door assembly. Additionally, easy disengagement of the structural filler from the jamb liner permits quick removal of the sash member retained within the frame by the structural filler. Further, the structural filler disengages from the jamb liner even when the sash member is still installed in the frame to facilitate quick and easy installation of window or door assembly without requiring removal of the sash member.

Moreover, the cooperative engagement between the structural filler and the jamb liner substantially prevents lateral movement of the sash member when the member is engaged with the structural filler. In one option, the structural filler and the jamb liner cooperate to substantially prevent rotation of the structural filler in a second direction opposite to the first direction (e.g., into the jamb liner). Because the structural filler does not rotate in the second direction, the structural filler substantially prevents lateral movement of the sash member over the structural filler due to forces, such as severe winds. The structural filler, in one option, is engaged with the sash member over a long surface (e.g., a flange) and forces acting on the sash member are correspondingly distributed to the structural filler over an elongated surface area. The forces are then transmitted to the jamb liner and the jamb member. Because the structural filler absorbs the forces acting on the sash member, unwanted stress is reduced at clutches, latches and the like that moveably couple the sash member to the jamb member. The forces acting on the sash member are thereby distributed over the structural filler and point loads at the clutches, latches and the like are minimized.

Furthermore, the structural filler and the jamb liner cooperate so the structural filler couples along the jamb liner without additional fasteners or tools. The structural filler therefore presents a substantially uniform surface free of putty marks, fasteners and the like. The structural filler and the sash member include a similar material, in one option, to provide a consistent appealing appearance to the window or door. In one example, the structural filler includes wood and matches the wooden sash member and/or jamb member.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
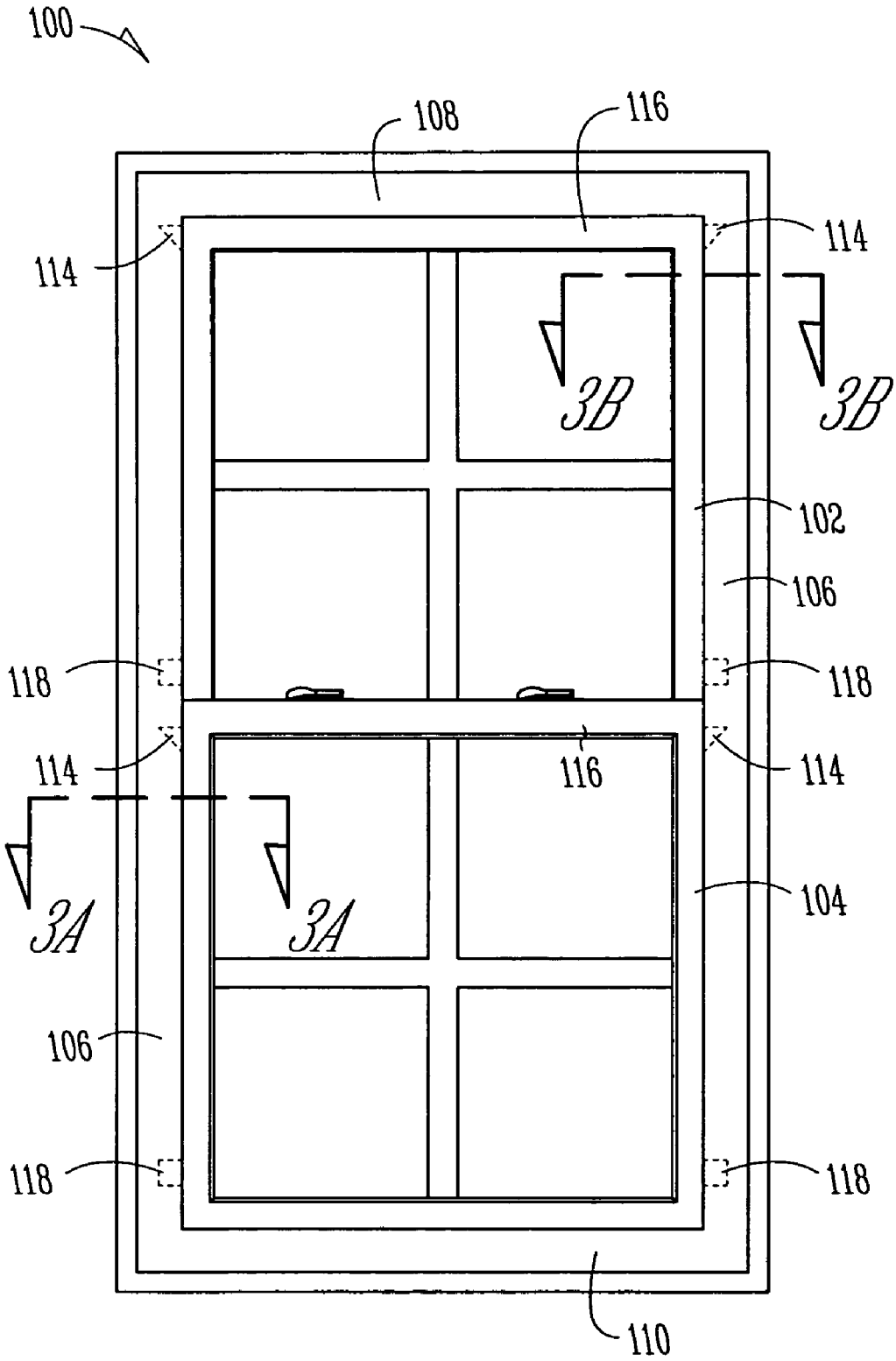
FIG. 1 is a front view of one example of a window including a structural filler system.

One example of a double or single hung window assembly 100 is shown in FIG. 1. Upper sash 102 and lower sash 104 are support by opposing jamb members 106, a header member 108 and a sill 110 opposite the header 108. In one option, at least the lower sash 104 is sized and shaped to slide vertically along the jamb members 106. The upper and lower sashes 102, 104 are sized and shaped to slide vertically along the jamb members 106, in another option. Optionally, the upper sash 102 is disposed toward an exterior of the window assembly 100 (e.g., closer to the outdoor side of the window assembly), and the lower sash 104 is disposed toward the interior (e.g., closer to the indoor side of the window assembly).

Figure 2:
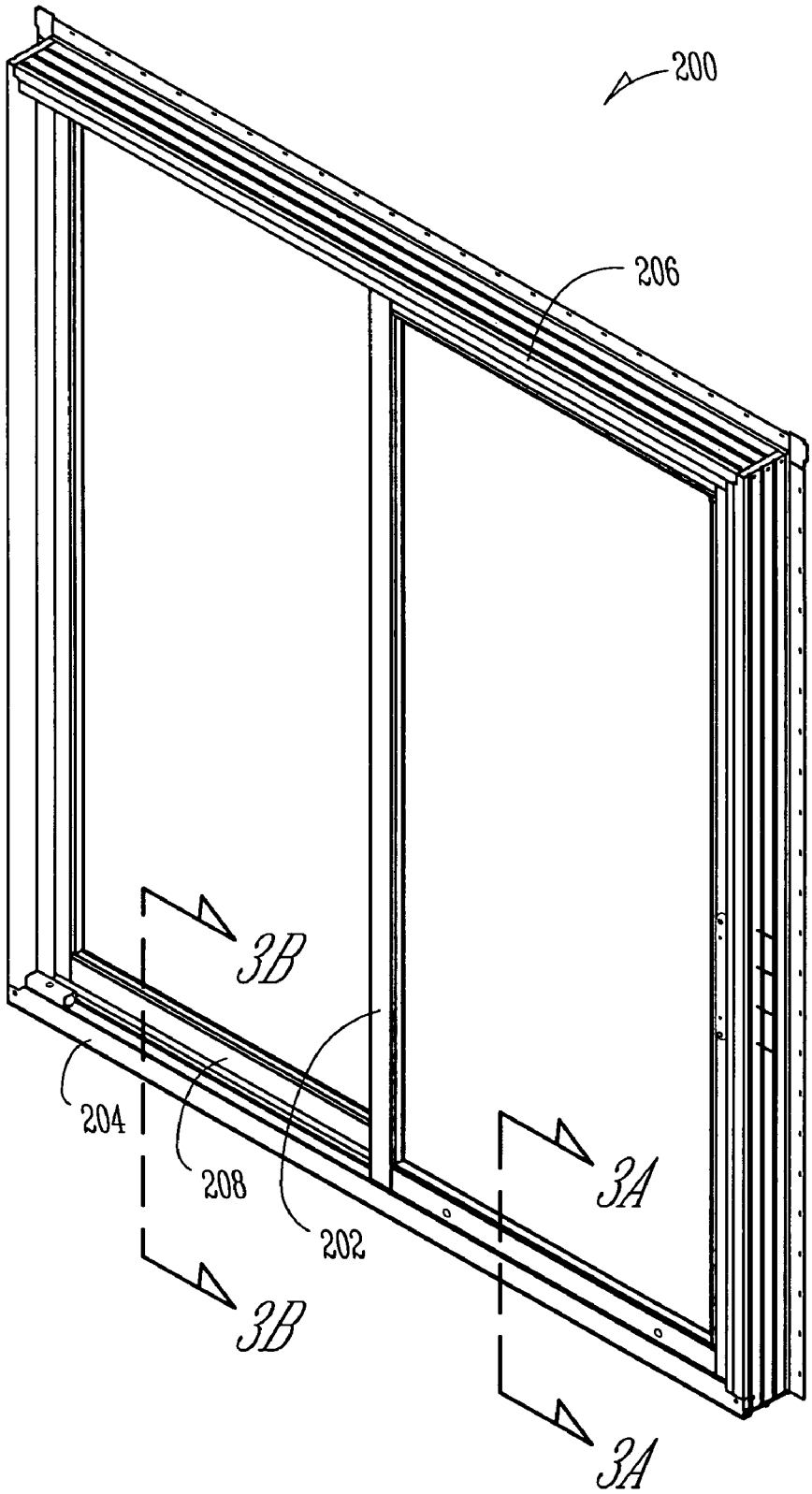
FIG. 2 is a perspective view of one example of a sliding door including a structural filler system.

One example of a sliding door assembly 200 is shown in FIG. 2. The sliding door assembly 200 includes at least one sash, such as a sliding door 202 sized and shaped to slide horizontally along the sill 204 (i.e., a member similar in function to the jamb member 106 shown in FIG. 1). Optionally, the sliding door 202 is sized and shaped to slide along the sill 204 and a header 206. The header 206 is a member slidably coupled with the sliding door 202 in a similar manner to the coupling between the jamb member 106 and sashes 102, 104, described above, in one option. In another option, the sliding door assembly includes a second sliding door 208 sized and shaped to slide along the sill 204 and/or the header 206. Another example of the window assembly includes sashes sized and shaped to slide horizontally in a similar manner to the sliding door 202 and second sliding door 208.

Figure 3A:
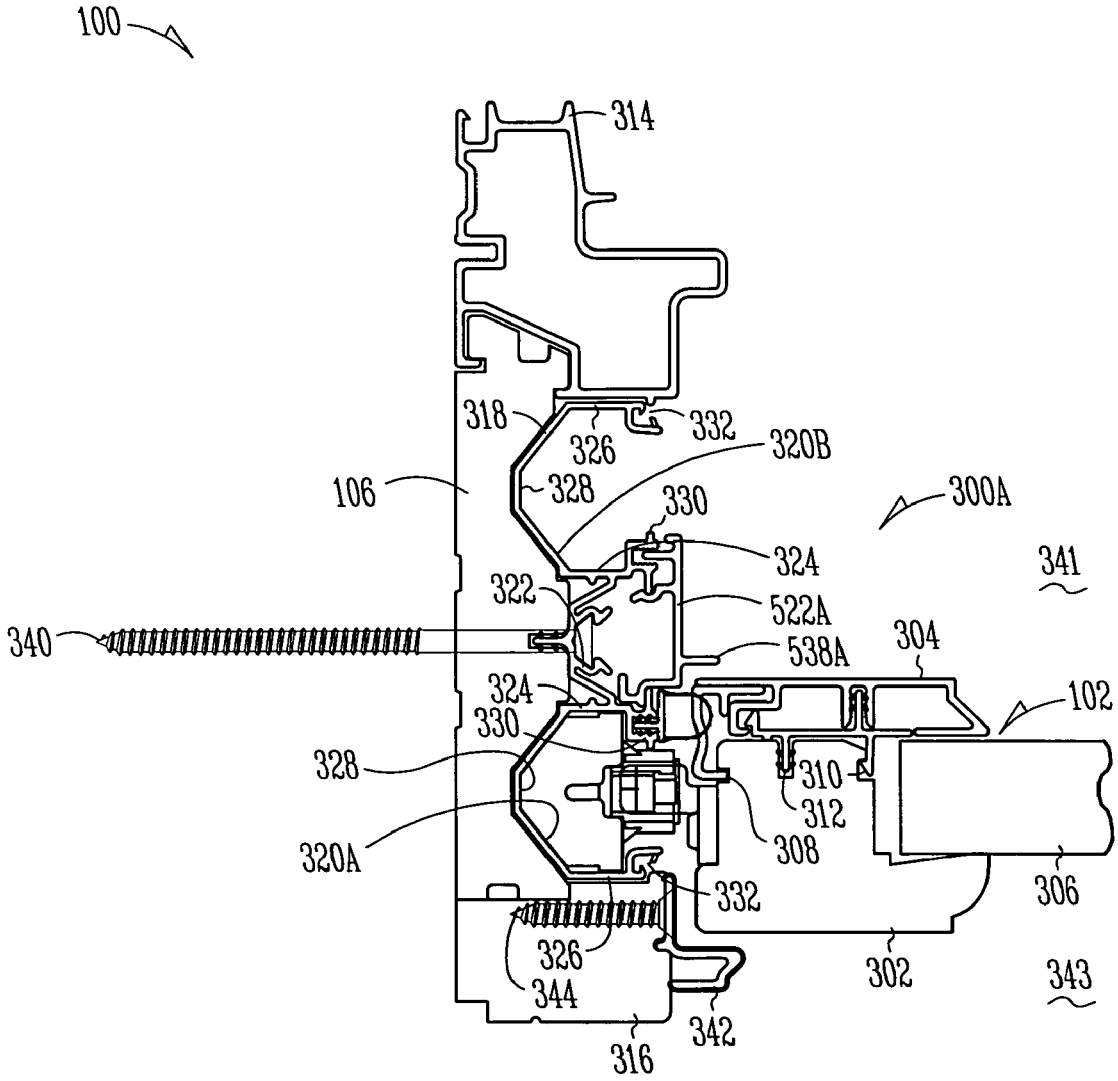
FIG. 3A is a sectional view taken along line 3A-3A of FIGS. 1 and 2 showing one example of a jamb assembly for the exterior of a window or door.

Referring now to FIGS. 3A, B, the window assembly 100 includes structural filler systems 300A, B coupled along the jamb members 106. Similar to the window assembly 100, the door assembly 200 includes the structural fillers 300A, B along at least the sill 204. The upper and lower sashes 102, 104 are slidably coupled along the structural filler systems 300A, B as further described below. As shown in FIGS. 3A, B, the upper and lower sashes 102, 104 include stiles 302 and stile cladding 304, in one option. The stile cladding 304, optionally, is constructed with, but not limited to polymers (e.g., polyvinyl chloride), metals, such as aluminum, and the like. The stile cladding 304 is formed, in another option, by extrusion, pultrusion, molding, machining and the like. In still another option, the sashes 102, 104 include stiles 302 and a stile trim piece formed with wood. A glass pane 306 is retained within the sashes 102, 104, in yet another option, by coupling the glass pane 306 between the stile 302 and the stile cladding 304. The stile cladding 304 is coupled to the stile 302 with hooks 308, catches 310, and barbed flanges 312, optionally. The stile cladding is coupled to the stile 302 with adhesives, tapes and like in still another option. Similarly, the glass pane 306 is coupled between the stile 302 and the stile trim piece with similar features to the stile cladding 304, in an additional option.

In another option, jamb cladding 314 is coupled along the jamb members 106 toward the exterior 341 of the window assembly 100. Like the stile cladding 304, the jamb cladding 314 is constructed with, but not limited to polymers (e.g., polyvinyl chloride), metals, such as aluminum, wood and the like. A jamb interior liner 316 is coupled along the jamb members 106 toward the interior 343 of the window assembly 100, in yet another option. Optionally, the jamb interior liner 316 is integral to the jamb member 106. The jamb interior liner 316 is constructed with wood, in still another option. As described above with the stile cladding 304, the jamb interior liner 316 and the jamb cladding 314 are coupled to the jamb member 106 with, but not limited to, hooks, catches, barbed flanges, adhesives, tapes and the like.

Figure 3B:
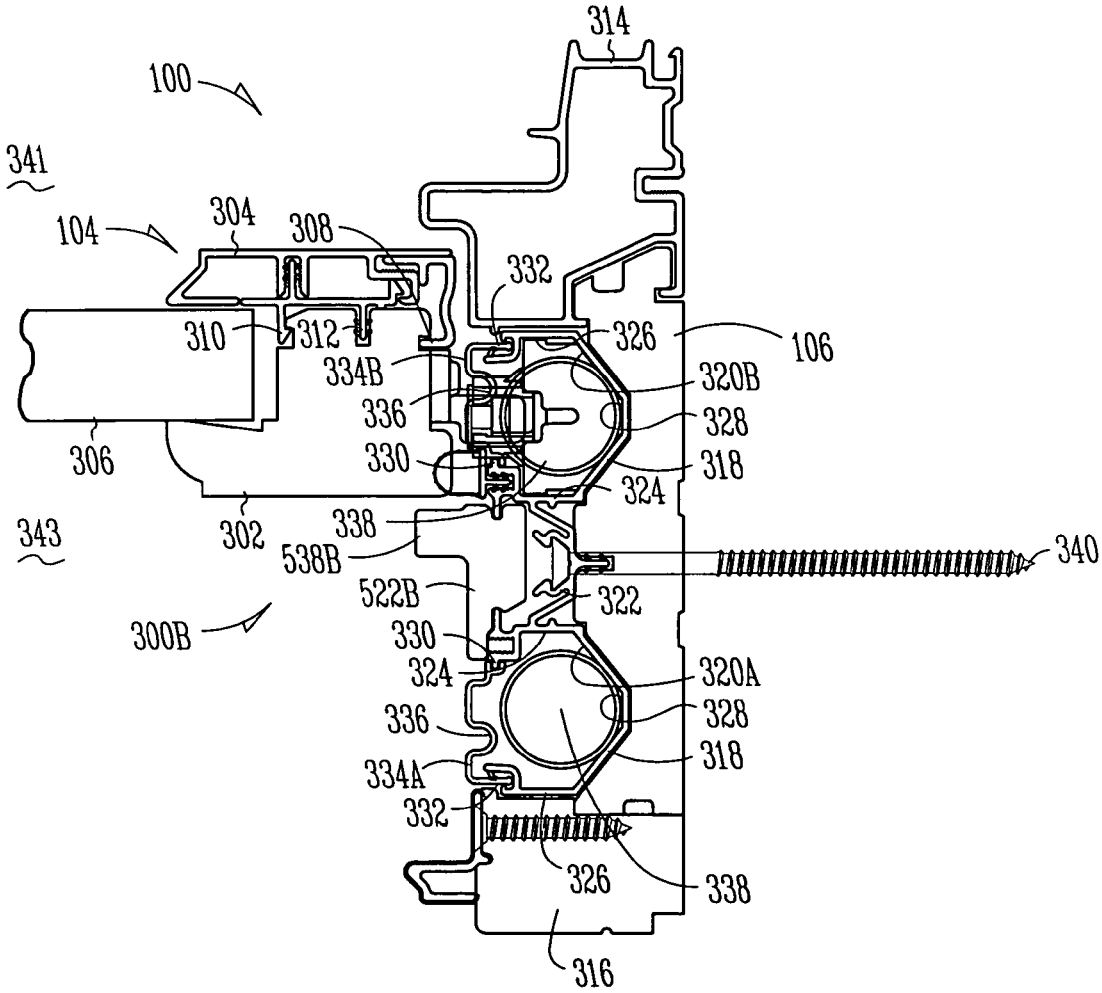
FIG. 3B is a sectional view taken along line 3B-3B of FIGS. 1 and 2 showing another example of a jamb assembly for the interior of the window or door.
Figure 4:
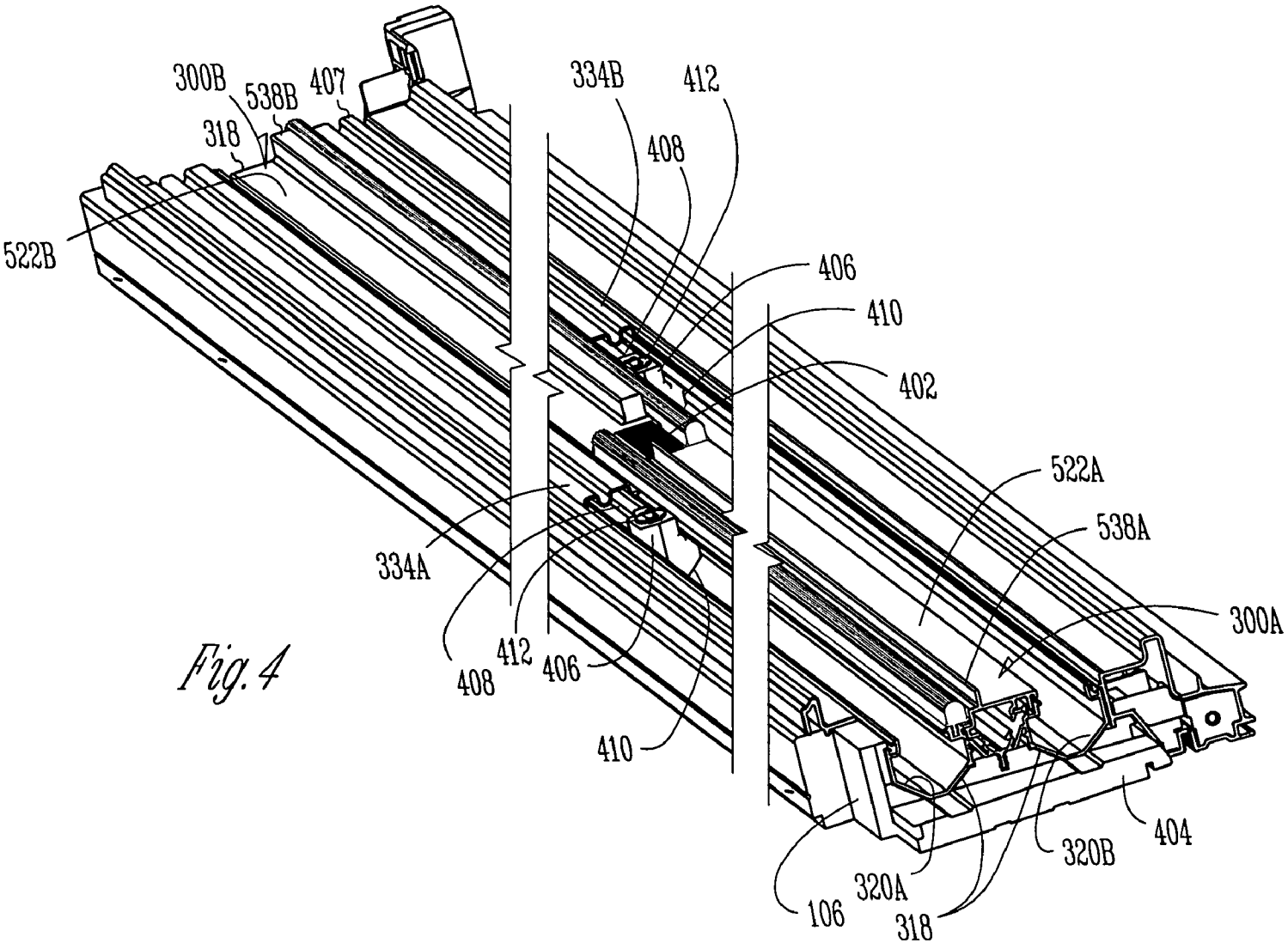
FIG. 4 is a perspective view of one example of the structural filler system.

Referring again to FIG. 3A, the structural filler system 300A, in one option, is associated with the lower portion of the window assembly 100, for instance, the portion of the window jamb members 106 adjacent to the lower sash 104 when the lower sash 104 is in the closed position shown in FIG. 1. FIG. 3B shows the structural filler system 300B, in another option, associated with the upper portion of the window assembly 100 (e.g., the portion of the window jamb members 106 adjacent to the upper sash 102 when the upper sash 102 is in the closed position shown in FIG. 1). Each structural filler system 300A, B has a substantially identical mirror image counterpart extending along the opposed jamb member 106. As shown in FIGS. 3A, 3B and 4, the structural filler systems 300A, B include jamb liners 318 extending along at least a portion of the jamb members 106 between the header 108 and the sill 110 (as shown in FIG. 1). In one option, the jamb liners 318 extend the length of the jamb members 106. As shown in FIG. 4, the structural filler system 300A includes a portion of the jamb liner 318 and extends from between the location 404 (e.g., where the sill 110 couples with the jamb member 106 in FIG. 1) to a check rail position 402 where the upper and lower sashes 102, 104 (FIG. 1) meet when the window assembly 100 is in a closed position. The structural filler system 300B includes another portion of the jamb liner 318 and extends from between the location 407 (e.g., where the header 108 couples with the jamb member 106 in FIG. 1) to the check rail position 402. The jamb liners 318 include, but are not limited to, metals (e.g., aluminum), plastics such as polyvinyl chloride, and the like. In another option, the jamb liners 318 are formed by extruding a semi-molten material (e.g., aluminum, polyvinyl chloride and the like) through a die having the cross sectional geometry of the jamb liner 318 thereby forming lineal sections of the jamb liner. The jamb liners 318 are formed by pultrusion, molding, machining and the like, in yet another option. In still another option, the jamb liners 318 are integral to the jamb members 106, for example, the jamb liners 318 and jamb members 106 are co-extruded. In still another option, the jamb liners 318 and the jamb members 106 are extruded from a single material (e.g., aluminum, polyvinyl chloride and the like).

As shown in FIGS. 3A, B, the jamb liners 318 of the structural filler systems 300A, B include balance channels 320A, B spaced apart by a web 322 extending therebetween. The balance channels 320A, B, in one option, have a generally U shaped geometry and include inner wall sections 324 and outer wall sections 326 joined by a rear wall section 328. In another option, the balance channels 320A, B include balance cover tabs 330 and balance cover recesses 332 sized and shaped to couple balance covers 334A,B (FIG. 3B) with the balance channels 320A, B. Channels 336 extends along the balance covers 334A, B. The channel 336 is sized and shaped to receive a blade member 114 extending from at least one of the sashes 102, 104 (FIG. 1). The balance covers 334A, B and the blade member 114 slidably couple the sashes 102, 104 with the jamb members 106 and permit movement of the sashes along the jamb member 106 (FIGS. 1 and 3A, B). Additionally, the blade members 114 received in the channels 336 of the balance covers 334A, B constrain lateral movement of the sashes 102, 104 (i.e., movement in and out of the plane defined by the window assembly 100) at the point of contact between the blade members 114 and the balance covers 334A, B.

As shown in FIG. 3B, the balance covers 334A, B, in one option, are coupled with the balance channels 320A, B of the structural filler system 300B (i.e., the structural filler system substantially adjacent to the upper sash 102 when the window assembly is in the closed position). Because the blade members 114 optionally extend from the upper rails 116 of the sashes 102, 104 (FIG. 1), the balance covers 334 extend along the jamb members 106 according to the range of travel of the blade members 114. As shown in FIG. 4, the balance cover 334A extends along the jamb liner 318 to just below the check rail position 402 because the blade member 114 of the sash 104 has a range of travel between the header 108 and the area just below the check rail position 402 (e.g., where the blade member 114 of the lower sash member 104 rests when the lower sash member is in the closed position shown in FIG. 1). The balance cover 334B extends along the jamb liner 318 to just above the check rail position 402 because the blade member 114 of the sash 104 has a range of travel between the header 108 and the area just above the check rail position 402 (e.g., where the blade member 114 of the upper sash member 104 rests when the upper sash member is in a substantially open position).

In another option, the balance channels 320A, B shown in FIG. 3B, include balance tubes 338 sized and shaped to fit within the balance channels 320A, B. Each balance tube 338 includes a biasing mechanism (e.g., springs, elastomers and the like) coupled with one of the sashes 102, 104. The balance tubes 338 substantially counterbalance the weight of the sashes 102, 104 and facilitate movement of the sashes along the jamb members 106. In yet another option, balance tubes 338 are carried in the balance channels 320A, B of each jamb member 106 on both sides of the sashes 102, 104 (i.e., a balance tube is in each balance channel on either side of each sash). Referring now to FIG. 4, the balance tubes 338 are coupled to the sashes 102, 104 with clutches 406 and flexible elements 408 extending between the balance tubes 338 and the clutches 406. The clutches 406 are sized and shaped to slidably couple with the balance channels 320A, B and transmit the counterbalancing force of the balance tubes 338 to the sashes 102, 104. The clutches 406 include an exterior geometry 410 corresponding to the geometry of the balance channels 320A, B. The clutches 406 are thereby substantially constrained from moving laterally within the balance channels 320A, B. The clutches 406 include pin recesses 412 sized and shaped to receive tilt pins 118 (FIG. 1). As shown in FIG. 1, the tilt pins 118 cooperate with the blade members 114 to retain the sashes 102, 104 within the window assembly 100 and constrain lateral movement of the sashes at the points of contact between the blade members 114 and the balance covers 334A, B (FIG. 3B), and between the tilt pins 118 and the clutches 406 (FIG. 4).

Optionally, at least one of the sashes 102, 104 are tilted around the tilt pins 118 to move the sashes out of the window assembly 100 for cleaning, replacement, repair and the like. The blade members 114 for each sash 102, 104 are pulled out of the channels 336 of the balance covers 334A, B, in one option, to permit rotation of the sashes 102, 104 out of the window assembly 100. In another option, as the sashes 102, 104 are rotated the tilt pins 118 rotate an anchor feature of each clutch 406 into engagement with the balance channels 320A, B. As the sashes 102, 104 are removed from the window assembly 100, the anchor features retain the clutches 406 at their last location along the balance channels 320A, B to facilitate easy coupling of the sashes 102, 104 thereon.

Figure 5A:
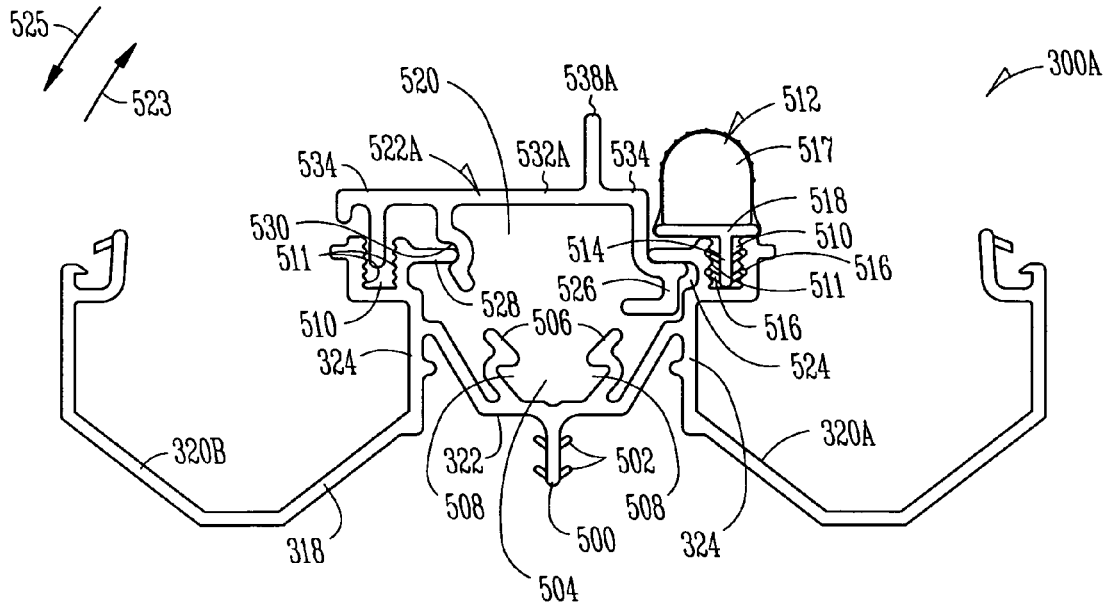
FIG. 5A is a sectional view of another example of the structural filler system.

Referring now to FIGS. 5A, B, the structural filler systems 300A, B are shown in the respective figures. As described above, the structural filler system 300A extends along the portion of the window jamb members 106 adjacent to the lower sash 104 when the lower sash 104 is in the closed position (FIG. 1). The structural filler system 300B extends along the portion of the jamb members 106 adjacent to the upper sash 102 when the upper sash 102 is in the closed position (FIG. 1). The structural filler systems 300A, B include the jamb liners 318. In one option, each jamb liner 318 includes the balance channels 320A, B and the web 322 extending therebetween. The structural filler systems further include structural fillers 522A, B (FIGS. 5A, B) coupled along the jamb liners 318, and further described below.

As shown in FIGS. 5A, B, the webs 322 include jamb flanges 500 sized and shaped to fit within a corresponding groove extending along at least a portion of the jamb members 106 (FIG. 1). The jamb flange 500, in one option, includes barbs 502 sized and shaped to form an interference fit between the jamb flange 500 and the jamb member 106. The jamb flanges 500 thereby couple the structural filler systems 300A, B with the jamb members 106. Optionally, the jamb flanges 500 extend along the jamb liner 318, for example, along the length of the jamb liner 318. In another option, a plurality of jamb flanges 500 extend from the jamb liner 318 at multiple points along the jamb liner 318.

The jamb liner 318 includes at least one fastener opening 504 sized and shaped to receive a fastener (e.g., screw, nail, bolt, rivet and the like). One example of a fastener is shown in FIGS. 3A, B, as jack screw 340. In one option, the fastener opening 504 extends through the web 322. In another option, the fastener opening 504 is a recess formed in the web 322 and the recess makes the web structurally weaker at the opening 504 to allow a fastener to pierce the web 322 when driven into the web. At least one retaining member 506 extends around a portion of the fastener opening 504, optionally. In yet another option, the retaining member 506 and the fastener opening 504 extend along the jamb liner 318, for instance, along the length of the jamb liner 318. The retaining member 506 includes a fastener notch 508 sized and shaped to receive the head of a fastener. The retaining member 506 is deformable and flexes as the head of a fastener engages against the retaining member 506 and snaps over the fastener head when the fastener is driven past the retaining member 506. The retaining member 506 thereby securely engages with the fastener and retains the fastener head against the jamb liner 318. The jamb flanges 500 are interposed between the fasteners along the jamb liner 318 and cooperate with the retaining member 506 to securely couple the fastener with the jamb member 106 (FIG. 1). One example of a retaining member is shown in Curtis et al., U.S. patent application Ser. No. 11/127,906, filed on May 12, 2005, entitled "JAMB ADJUSTMENT AND SECUREMENT AND METHODS THEREFOR," which is assigned to the assignee of the present application and incorporated by reference herein in its entirety.

Referring again to FIGS. 5A, B, the jamb liners 318 include weather strip grooves 510 on either side of a fastener groove 520. The weather strip grooves 510 are formed in the inner wall sections 324, in one option. In another option, the inner wall sections 324 defining the weather strip grooves 510 include rough surfaces 511 (e.g., serrated, knurled, and the like). A weather strip 512 is coupled along the jamb liner 318 with a weather strip flange 514. The weather strip grooves 510 are sized and shaped to receive the weather strip flange 514. The weather strip flange 514, optionally, includes barbs 516 sized and shaped to create an interference fit between the weather strip 512 and the rough surfaces 511 that define the weather strip grooves 510. The weather strip 512 includes a deformable bulb 517 sized and shaped to slidably couple along the sashes 102, 104 (FIG. 1). The deformable bulb 517 is coupled with a platform 518, in yet another option, and the weather strip flange 514 extends from the platform 518. In still another option, the deformable bulb 517 is formed with a closed cell foam with a low friction jacket extending around the closed cell foam to facilitate sliding movement between weather strip 512 and the sashes 102, 104. In a further option, the deformable bulb 517 is formed with an open cell foam with a low friction jacket extending around the open cell foam.

As shown in FIGS. 5A, B, the fastener groove 520 is defined by the inner wall sections 324 and the web 322. In one option, the fastener groove 520 contains the retaining members 506 and fastener opening 504. In another option, the fastener groove 520 is sufficiently deep to space the retaining members 506 and the fastener opening 504 from the structural fillers 522A, B coupled over the fastener groove 520. The jamb liner 318 includes a filler recess 524 defined by the inner wall section 324. The filler recess 524 is sized and shaped to receive a corresponding projection 526 extending from the structural fillers 522A, B. In another option, the jamb liners 318 include projections and the structural fillers 522A, B include recesses sized and shaped to receive the projection. The jamb liner 318 further includes at least one filler footing 528 defined by the inner wall section 324. Optionally, the filler footing 528 is a planar surface extending into the fastener groove 520. In yet another option, the filler footing 528 is remote from the filler recess 524, for instance, on the opposing side of the fastener groove 520. The filler footing 528 is sized and shaped to engage with at least one contact surface 530 of the structural fillers 522A, B.

As shown in FIG. 5A, the structural filler 522A includes a base member 532A sized and shaped to extend over the fastener groove 520. The contact surface 530 and the projection 526 are remote from each other (e.g., on opposing ends of the structural filler) and extend from the base member 532A. The base member 532A is dimensioned to ensure the projection 526 is received in the recess 524 when the contact surface 530 is engaged against the footing 528. The base member 532A has a substantially uniform outer surface 534 that conceals the fastener opening 504, retaining member 506 and any fasteners, such as jack screw 340 (FIG. 3) extending through the opening. The outer surface 534 of the base member 532A is free of fasteners, putty and the like and thereby presents a uniform smooth and appealing appearance (e.g., is substantially flawless). In another option, the outer surface 534 has a similar finish (e.g., color, wood grain appearance and the like) to at least one of the jamb members 106 (FIG. 1), sash members 102, 104, balance covers 334A, B (FIGS. 3A, B), jamb cladding 314, jamb interior liner 316 and the like. The structural filler 522A thereby provides an appealing, consistent and uniform appearance to the window assembly 100 (FIG. 1). The base member 532A is constructed with, but not limited to metals, such as aluminum, plastics, wood and the like. In one option, the base member 532A is constructed with the same wood used in the jamb interior liner 316 and/or the sash members 102, 104. In one option, the base member 532A is an extruded plastic such as polyvinyl chloride. In another option, the base member 532A is formed by pultrusion, machining, molding and the like.

Figure 5B:
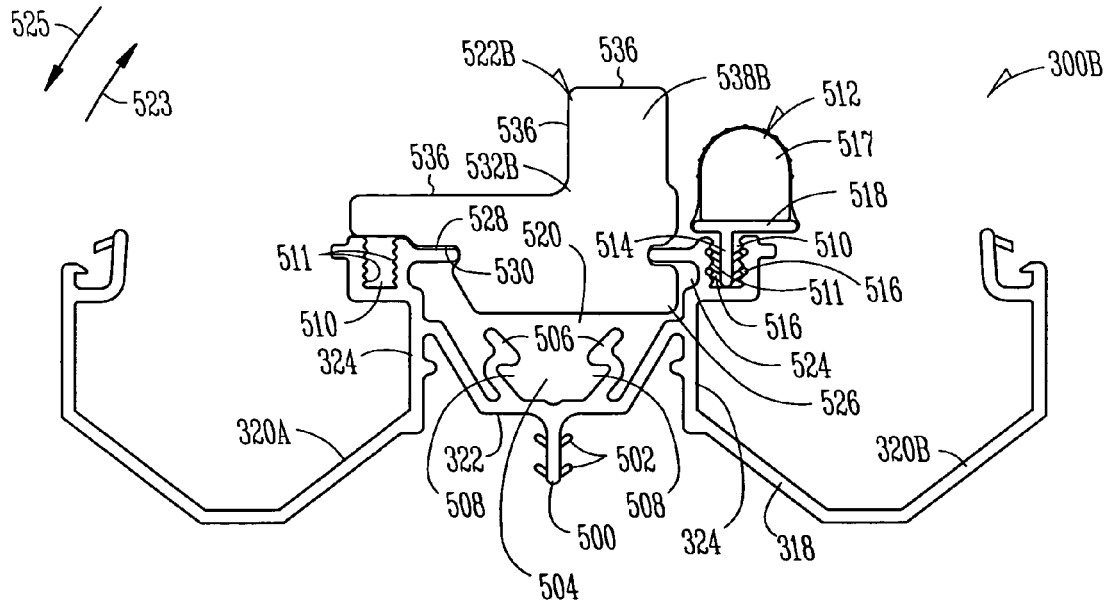
FIG. 5B is a sectional view of yet another example of the structural filler system.

Referring now to FIG. 5B, the structural filler 522B includes a base member 532B sized and shaped to extend over the fastener groove 520. The contact surface 530 is remote from the projection 526 (e.g., on the opposing side of the structural filler) and both extend from the base member 532B. Similar to the base member 532A, the base member 532B is dimensioned to ensure the projection 526 is received in the recess 524 when the contact surface 530 is engaged against the footing 528. The base member 532B has a substantially uniform outer surface 536 that conceals the fastener opening 504, retaining member 506 and any fasteners, such as jack screw 340 (FIG. 3) extending through the opening. Similar to the outer surface 534 of the base member 532A, the outer surface 536 of the base member 532B is free of fasteners, putty and the like and thereby presents a uniform smooth and appealing appearance (e.g., is substantially flawless). In another option, the outer surface 536 has a similar finish (e.g., color, wood grain appearance and the like) to at least one of the jamb members 106 (FIG. 1), sash member 102, 104, balance covers 334A, B (FIGS. 3A, B), jamb cladding 314, jamb interior liner 316 and the like. The structural filler 522B thereby provides an appealing consistent and uniform appearance to the window assembly 100 (FIG. 1). The base member 532B is constructed with, but not limited to wood, metals, such as aluminum, plastics and the like. In one option, the base member 532B is constructed with the same wood used in the jamb interior liner 316 and/or the sash members 102, 104.

The structural fillers 522A, B, shown in FIGS. 5A, B, include flanges 538A, B sized and shaped to engage with at least one of the sash members 102, 104. The flanges 538A, B extend away from the respective base members 532A, B (e.g., at approximately a 90 degree angle with respect to the base members). In one option, the flanges 538A, B extend along the structural fillers 522A, B and thereby extend along at least a portion of the jamb liners 318 and jamb members 106. In another option, the flanges 538A, B extend substantially the length of the structural fillers 522A, B (FIG. 4) and are thereby sized and shaped to extend along at least one of the sash members 102, 104 when the sash members are in the closed position shown in FIG. 1. The flanges 538A, B of the structural fillers 522A, B thereby provide a long surface with a corresponding long surface area sized and shaped to engage with the sash members 102, 104 and absorb forces (e.g., from high winds) acting upon the sash members, as described below. In yet another option, where the filler 522A includes wood, the wood flange 538A extending therefrom extends along a portion of the jamb liner 318 (e.g., from the sill 110 to a location below the check rail position 402) to permit sliding movement of the upper sash 102 without interference from the flange 538A. Optionally, the structural filler 522A is constructed of two or more portions (e.g., two pieces), with a first portion including a flange 538A and the first portion extends from the sill 110 to a location below the check rail position 402. The second portion of the structural filler 522A is without a flange 538A and extends from the check rail position 402 to the first portion of the structural filler 522A to permit sliding movement of the upper sash 102.

Figure 6A:
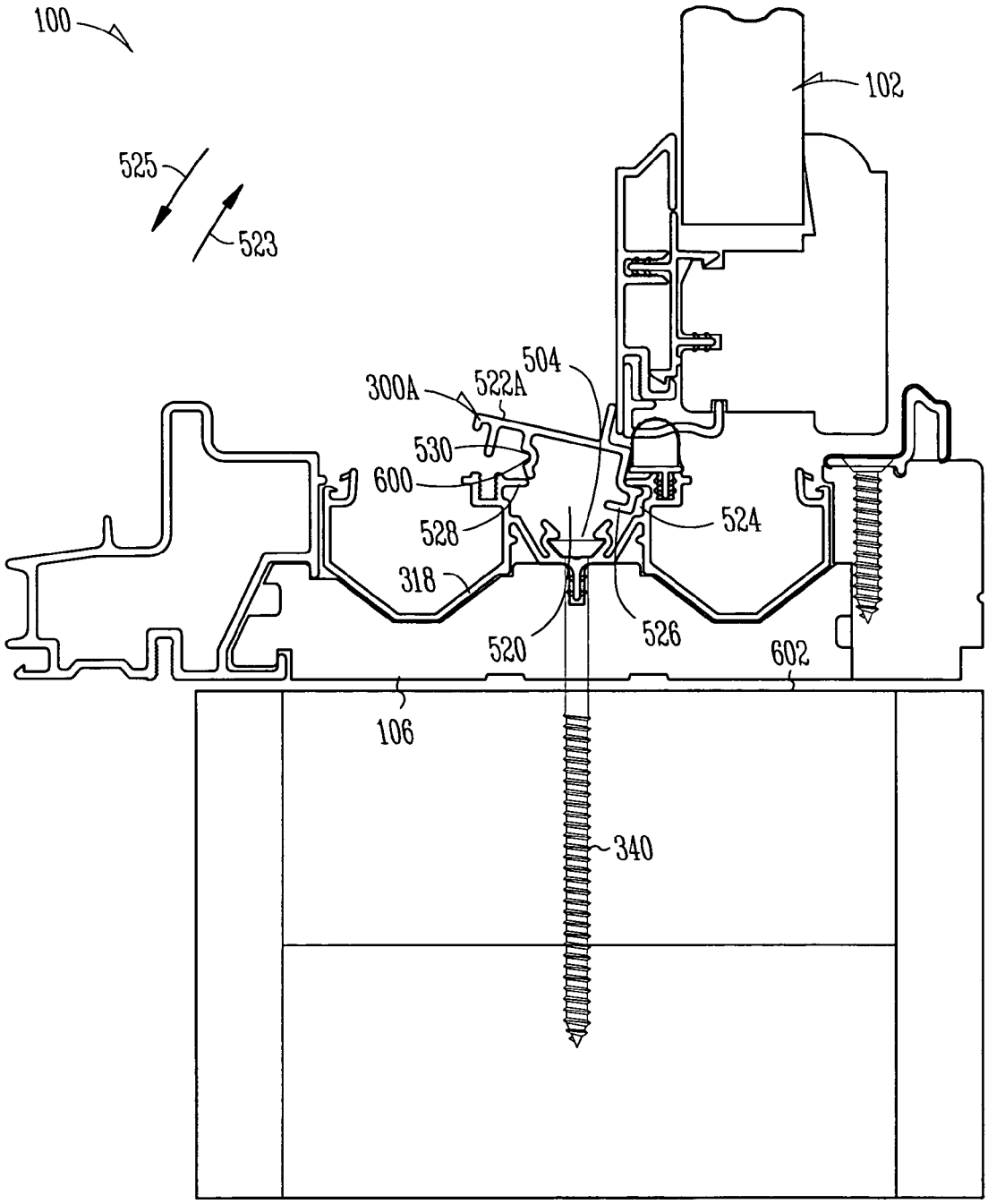
FIG. 6A is a sectional view of the jamb assembly shown in FIG. 3A with the structural filler partially rotated out of engagement with the jamb liner.
Figure 6B:
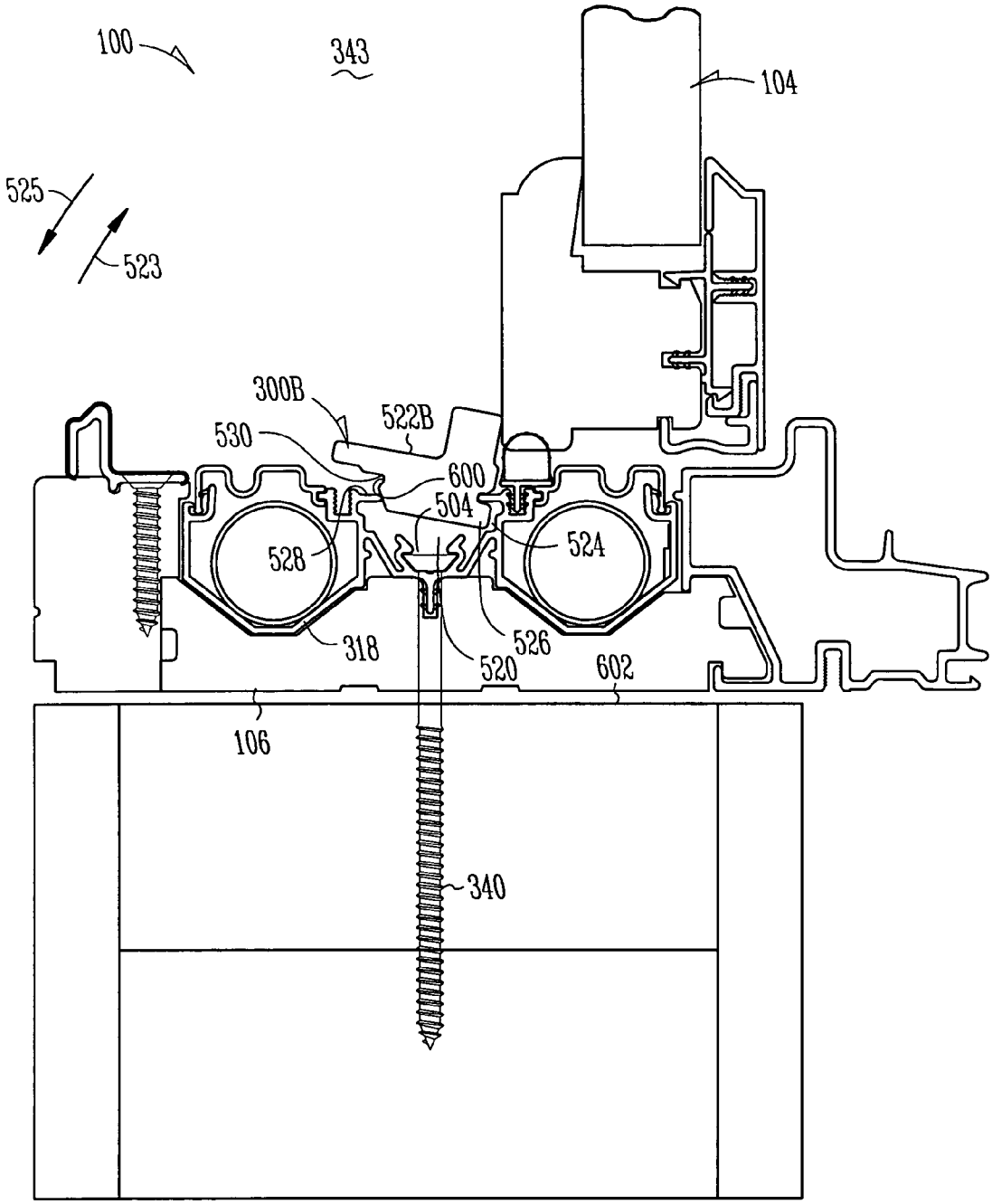
FIG. 6B is a sectional view of the jamb assembly shown in FIG. 3B with the structural filler partially rotated out of engagement with the jamb liner.

Referring again to FIGS. 5A, B, when the structural fillers 522A, B are coupled along the jamb liners 318, the filler recess 524 and the projection 526 cooperate with the filler footing 528 and the contact surface 530 to permit free rotation (e.g., with pressure applied by hand) of the structural fillers 522A, B around the projection 526 in a first direction 523 into the orientation shown in FIGS. 6A, B. In one option, the projection 526 acts as a pivot around which the structural fillers 522A, B rotate. Once in the position shown in FIGS. 6A, B, the structural fillers 522A, B are easily and quickly removed from the jamb liner 318 by pulling the projection 526 out of the filler recess 524. Quick removal of the structural fillers 522A, B provides easy access to the fastener groove 520 and a fastener, such as jack screw 340 extending through the fastener opening 504. Additionally, the structural fillers 522A, B are easily uncoupled from the jamb liners 318 to permit quick removal of the sashes 102, 104 for replacement, repair, cleaning and the like.

As shown in FIGS. 5A, B, the filler recess 524 and the projection 526 cooperate with the filler footing 528 and the contact surface 530 to substantially prevent rotation of the structural fillers 522A, B in a second direction 525 when the structural fillers are coupled to the jamb liner 318. The structural fillers 522A, B are thereby securely held in place and substantially prevented from rotating in the second direction 525, for instance, when the sashes 102, 104 (FIG. 1) engage against the respective fillers 522A, B at the flanges 538A, B due to large forces (e.g., high winds). Additionally, the structural fillers 522A, B are securely retained between the sash members 102, 104 and the jamb liners 318 when the sash members 102, 104 engage with the fillers because of the cooperative coupling between the fillers and the jamb liners 318. The engagement of the sashes 102, 104 with the flanges 538A, B securely seats the structural fillers 522A, B in the jamb liners 318 at the filler footing 528 and the filler recess 524 to substantially prevent lateral movement of the sashes 102, 104 (e.g., because of high winds) over the structural fillers 522A, B.

In another option, shown in FIGS. 6A, B, where the structural fillers 522A, B are uncoupled with the jamb liners 318, the projections 526 are placed within the filler recesses 524 and the structural fillers 522A, B are freely rotated (e.g., with pressure from the hand) in the second direction 525 until the contact surfaces 530 engage with the footings 528 of the jamb liner 318 (as shown in FIGS. 5A, B). The rotation of the structural fillers 522A, B couples the fillers with the jamb liners 318. Optionally, coupling the structural fillers 522A, B along the jamb liners 318 is performed with pressure applied by the hand and substantially without any tools. Additional fasteners (e.g., nails, staples, bolts and the like) are not needed to couple the structural fillers 522A, B along the jamb liners 318. The structural fillers 522A, B are thereby easily coupled with the jamb liners 318. In yet another option, at least one of the contact surfaces 530 and the footings 528 include fasteners sized and shaped to releasably couple the structural fillers 522A, B with the jamb liners 318. In one example, the contact surfaces 530 include notches 600 sized and shaped to create a snap fit with the footings 528 when the structural fillers 522A, B are rotated into engagement with the jamb liner 318. Other examples of fasteners include, but are not limited to, adhesives, tapes, hook and loop material, friction surfaces (tacky rubber, roughened surfaces) and the like. Rotation of the structural fillers 522A, B around the projection 526, for instance with pressure applied by hand, overcomes the releasable coupling between the contact surfaces 530 and the footings 528 and permits free rotation of the fillers with respect to the jamb liners 318.

Referring again to FIG. 3A, the sash member 102 is shown coupled along the jamb member 106 with the structural filler system 300A therebetween. The jamb interior liner 316 includes a jamb stop 342 coupled along the interior liner 316. In one option, the jamb stop 342 is coupled to the jamb interior liner 316 with at least one fastener 344 (e.g., screw, bolt, nail, weld, adhesive and the like). In another option, the jamb stop 342 is integral to the jamb interior liner 316. The jamb stop 342 and the flange 538A extend over a portion of the sash member 102 and retain the sash member 102 therebetween. The structural filler 522A is disposed toward the exterior 341 of the window assembly 100 and the jamb stop 342 is disposed closer to the interior 343 of the window assembly 100. In operation, when force is applied to the sash member 102 from the exterior 341, for instance by high pressure due to winds, impacts and the like, the sash member 102 engages with the jamb stop 342 and the jamb stop 342 substantially prevents lateral movement of the sash member 102 toward the interior 343 of the window assembly 100. Optionally, the jamb stop 342 extends along the jamb interior liner 316 and provides a long surface with a relatively large area adapted to distribute the forces acting on the sash member 102. The forces are then transmitted to the jamb member 106 and to the frame of a building coupled around the window assembly 100, in yet another option.

When force is applied to the sash member 102 from the interior 343 of the window assembly 100, for instance due to extreme low pressures at the exterior 341 and corresponding higher pressures at the interior 343, the sash member 102 engages against the flange 538A of the structural filler 522A. As described above, the cooperative coupling between the structural filler 522A and the jamb liner 318 substantially prevents lateral movement of the sash member 102 over the structural filler 522A toward the exterior 341. Referring again to FIG. 5A, the projection 526 and the filler recess 524 cooperate with the contact surface 530 and the footing 528 to substantially prevent rotation of the structural filler 522A in the second direction 525. As shown in FIG. 3A, the cooperation between the structural filler 522A and the jamb liner 318 securely holds the flange 538A in place (i.e. the flange 538A is substantially prevented from moving laterally toward the exterior 341) and substantially prevents the sash member 102 from moving laterally past the flange 538A. The flange 538A, extends along the structural filler 522A, in one option, and the structural filler 522A is adapted to absorb at least 3.75 pounds per inch of filler (e.g., flange 538A) length to the jamb member 106 when the sash member 102 is engaged with the structural filler 522A (e.g., engaged along the flange 538A extending along at least a portion of the length of the filler 522A). In still another option, the structural filler 522A and the jamb liner 318 are adapted to transmit at least approximately 6.0 pounds per inch of filler length to the jamb member 306 when the sash 102 is engaged with the structural filler 522A. The long surface of the flange 538A distributes the force from the sash member 102 over a large area and minimizes point loading and corresponding high stresses at the blade members 114 and tilt pins 118 (FIG. 1). The force absorbed by the structural filler 522A through engagement of the sash 102 with the flange 538A is transmitted into the jamb liner 318 and from there to the jamb member 106.

In another option, where the filler 522A includes wood, the wood flange 538A extending therefrom extends along a portion of the jamb liner 318 (e.g., from the sill 110 to a location below the check rail position 402), as described above. The lack of the flange 538A immediately below the check rail position 402 permits sliding movement of the upper sash 102 without interference from the flange 538A. The flange 538A continues to provide a large area to distribute forces from the sash 102 over the structural filler 522A while minimizing point loading. Optionally, the structural filler 522A is constructed of two or more portions (e.g., two or more pieces), with a first portion including a flange 538A and the first portion extends from the sill 110 to a location below the check rail position 402. The second portion of the structural filler 522A is without a flange 538A and extends from the check rail position 402 to the first portion of the structural filler 522A to permit sliding movement of the upper sash 102.

In yet another option, as described above, the sash member and jamb member include members used in the door assembly 200 (FIG. 2) such as sliding doors 202, 208 and sills 204 and headers 206, respectively. The structural filler system 300A, in one example, is coupled between at least the sill and the sliding door 208 and performs substantially the same function in the door assembly 200 as in the window assembly 100.

Referring now to FIG. 3B, the sash member 104 is shown coupled along the jamb member 106 with the structural filler system 300B therebetween. At least a portion of the jamb cladding 314 extends over a portion of the sash member 104. The flange 538B extends over a portion of the sash member 104 and the jamb cladding 314 and the flange 538B retain the sash member 104 therebetween. The structural filler 522B is disposed toward the interior 343 of the window assembly 100 and the jamb cladding 314 is disposed toward the exterior 341 of the window assembly 100. In operation, when force is applied to the sash member 104 from the interior 343, for instance due to extreme low pressures at the exterior 341 and corresponding higher pressures at the interior 343, the sash member 104 engages with the jamb cladding 314 and the cladding 314 substantially prevents lateral movement of the sash member 104 toward the exterior 341 of the window assembly 100. Optionally, the jamb cladding 314 extends along the jamb member 106 and provides a long surface with a corresponding large area adapted to distribute the forces acting on the sash member 104. The forces are then transmitted to the jamb member 106 and to the frame of a building coupled around the window assembly 100, in yet another option.

When force is applied to the sash member 104 from the exterior 341 of the window assembly 100, for instance by high pressure due to winds, impacts and the like, the sash member 104 engages against the flange 538B of the structural filler 522B. As described above, the cooperative coupling between the structural filler 522B and the jamb liner 318 substantially prevents lateral movement of the sash member 104 over the structural filler 522B toward the interior 343. Referring again to FIG. 5B, the projection 526 and the filler recess 524 cooperate with the contact surface 530 and the footing 528 to substantially prevent rotation of the structural filler 522B in the second direction 525. As shown in FIG. 3B, the cooperation between the structural filler 522B and the jamb liner 318 thereby securely holds the flange 538B in place (i.e. the flange is substantially prevented from moving laterally toward the interior 343) and substantially prevents the sash member 104 from moving laterally past the flange 538B. The flange 538B extends along the structural filler 522B, in one option, and the structural filler 522B is adapted to absorb at least 3.75 pounds per inch of filler (e.g., flange 538B) length to the jamb member 106 when the sash member 104 is engaged with the structural filler 522B (e.g., engaged along the flange 538B extending along at least a portion of the length of the filler 522B). In still another option, the structural filler 522B and the jamb liner 318 are adapted to transmit at least approximately 6.0 pounds per inch of filler length to the jamb member 306 when the sash 104 is engaged with the structural filler 522B.

The long surface of the flange 538B distributes the force from the sash member 104 over a large area and minimizes point loading and corresponding high stresses at the blade members 114 and tilt pins 118 (FIG. 1). The force absorbed by the structural filler 522B through the flange 538B is transmitted into the jamb liner 318 and from there to the jamb member 106. The structural filler system 300B, in one example, is coupled between at least the sill and the sliding door 202 and performs substantially the same function in the door assembly 200 as in the window assembly 100.

Additionally, installation and removal of the window assembly 100 as well as repair, replacement and cleaning of the sash member 102, 104 are facilitated with the structural filler systems 300A, B. Referring again to FIGS. 6A, B, the window assembly 100 is positioned within the rough opening of a wall, ceiling and the like. The sashes 102, 104 come preinstalled within the window assembly 100, in one option. In another option, the structural fillers 522A, B are uncoupled by freely rotating the fillers around the projections 526 in the direction 523, as described above. The structural fillers 522A, B are rotated with pressure applied by the hand, in one example. In another example, the structural fillers 522A, B are rotated substantially without tools. The free rotation of the structural fillers 522A, B provides easy access to the fastener grooves 520 and the fastener openings 504 disposed therein. Optionally, the window assembly 100 comes with the structural fillers 522A, B uncoupled to provide immediate access to the fastener openings 504. Fasteners, such as jack screws 340, are then driven through the fastener openings 504 and the jamb members 106 and into the surface 602 that defines the rough opening. Once the window assembly 100 is secured within the rough opening, the structural fillers 522A, B are replaced. The projections 526 are placed within the filler recesses 524 of the jamb liners 318 and the structural fillers 522A, B are rotated (e.g., by hand) in the direction 525 until the contact surfaces 530 engage with the footings 528 (FIGS. 5A, B). Additional fasteners (e.g., is staples, nails, screws and the like) are unnecessary to couple the structural fillers 522A, B along the jamb members 106. Removal of the window assembly 100 is performed in the preceding manner repeated substantially in reverse. Installation and removal of the window assembly 100 with preinstalled sashes 102, 104 is therefore quick and easy. Additionally, the structural fillers 522A, B easily rotate into and out of engagement with the jamb liners 318 to further decrease installation and removal times. As described above, the structural filler system 300A, in one example, is coupled between at least the sill 204 and the sliding door 208 of the door assembly 200 and the structural fillers 522A, B are rotated into and out of engagement to decrease installation and removal times in a similar manner as the window assembly 100.

In another option, when removal of one or both of the sashes 102, 104 is desired, the structural filler system 300A, B facilitates quick access to permit uncoupling of the sashes 102, 104 from the window assembly 100. The structural fillers 522A, B are rotated in the direction 523 to disengage the contact surfaces 530 from the footings 528. The structural fillers 522A, B are freely rotated (e.g., by hand) away from the jamb liners 318 to uncouple the fillers from the liners 318. The blade members 114 shown in FIG. 1 are pulled out of the channels 336 (FIG. 3) and the sashes 102, 104 are tilted around the tilt pins 118 and pulled out of the window assembly 100. Replacement of the sashes 102, 104 is performed in a similar manner with the steps previously described performed in reverse.

As shown in FIGS. 5A, B, the structural fillers 522A, B conceal the fastener grooves 520, fastener openings 504 and fasteners, such as jack screw 340 extending through the opening. The outer surface 534 of the structural filler 522A and the outer surface 536 of the structural filler 522B are free of fasteners, putty and the like and thereby present a smooth and appealing appearance. In another option, the outer surfaces 534, 536 of the structural fillers 522A, B have similar finishes (e.g., color, wood grain appearance and the like) to at least one of the jamb members 106, sashes 102, 104, balance covers 334A, B (FIGS. 3A, B), jamb cladding 314, jamb interior liner 316 and the like. The structural fillers 522A, B thereby provide an appealing, consistent and uniform appearance to the window assembly 100 (FIG. 1). In yet another option, the outer surface 536 of the structural filler 522B is constructed with the same wood used in at least one of the jamb interior liner 316, jamb cladding 314, jamb members 106, sashes 102, 104 and the like, to provide a consistent wooden appearance to the window assembly 100. The structural fillers 522A, B, optionally, provide an appealing, consistent and uniform appearance to the door assembly 200 and also conceal the fastener openings therein.

Figure 7:
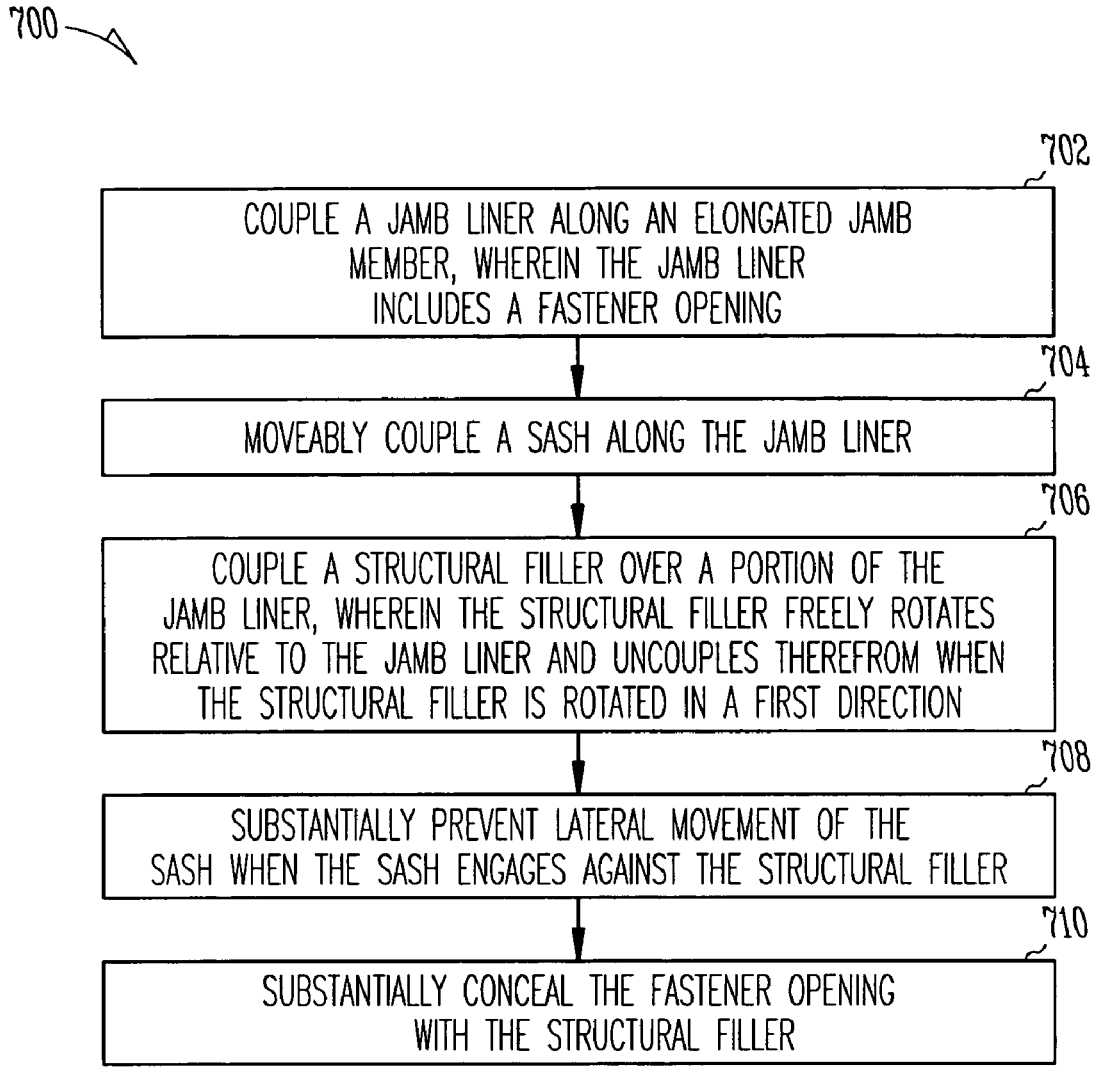
FIG. 7 is a block diagram showing one example of a method for making a window or door assembly.

FIG. 7 is a block diagram showing a method 700 for making a window or door assembly. At 702, a jamb liner is coupled along an elongated jamb member. The jamb liner includes a fastener opening (e.g., hole, recess and the like). In one option, the jamb liner and the jamb member are integral. At 704, a sash member is moveably coupled along the jamb liner. At 706, a structural filler is coupled over a portion of the jamb liner, and the structural filler freely rotates relative to the jamb liner and uncouples therefrom when the structural filler is rotated in a first direction. At 708, lateral movement of the sash is substantially prevented when the sash engages against the structural filler. At 710, the structural filler substantially conceals the fastener opening. In another option, the structural filler is extruded with, for instance, a metal such as aluminum, plastics such as polyvinyl chloride, and the like. Optionally, the structural filler is formed by pultrusion, molding, machining and the like.

The method 700 includes, in another option, coupling the jamb member with a surface defining a rough opening (e.g., an opening in a wall, ceiling and the like) after moveably coupling the sash member along the jamb member. In one example, the sash is preinstalled to provide a nearly complete window or door assembly prior to installation. Coupling the jamb member with the surface defining the rough opening includes passing a fastener through the fastener opening, in yet another option. Optionally, coupling the structural filler over the portion of the jamb liner includes concealing the fastener. In still another option, the sash is moveably coupled along the jamb liner before coupling the structural filler with the jamb liner. In another example, the sash member is moveably coupled along the jamb liner to provide a nearly fully assembled window or door assembly and the structural filler is coupled along the jamb liner thereafter (i.e., access is available to one or more fastener openings for installation of the nearly assembled window or door assembly).

In yet another option, the method 700 includes transmitting a force (e.g., from pressure differentials created by high wind loads) from the sash member to the structural filler when the sash member engages against the structural filler. The force is then transmitted from the structural filler to the jamb liner and from the jamb liner to the jamb member. Force is thereby distributed over the large elongated area of the structural filler engaged with the sash member. Other features, such as blade members, clutches and latches thereby receive a substantially decreased portion of the force at points along the sash member as the structural filler absorbs the majority of the force.

Optionally, the method 700 further includes coupling the structural filler over the portion of the jamb liner without tools (e.g., hammers, screw drivers, prybars and the like). In another option, the method 700 includes rotating the structural filler in a first direction and uncoupling the structural filler from the jamb liner without tools. Coupling the structural filler over the portion of the jamb liner includes, in yet another option, coupling the structural filler over the portion of the jamb liner with a space therebetween. In still another option, a jamb stop is coupled with the jamb member, and the sash member is retained between the jamb stop and the structural filler. The method 700 includes, in an additional option, coupling a cladding with the jamb member, and retaining the sash member between the cladding and the structural filler.

The above described structural filler system provides a load bearing filler that facilitates easy access to jamb member fastener openings and fasteners therein without requiring removal of the sash member (or a sliding door) from the jamb member (including frame members, such as sill and header members). The structural filler couples with the jamb liner to permit free rotation of the structural filler (e.g., with pressure applied by hand and without tools) when rotated in a first direction. The structural filler is thereby easily disengaged from the jamb liner to expose fasteners and fastener features and allow for installation and removal of the window or door assembly. Additionally, easy disengagement of the structural filler from the jamb liner permits quick removal of the sash member retained within the frame by the structural filler. Further, the structural filler disengages from the jamb liner even when the sash member is still installed in the frame to facilitate quick and easy installation of window or door assembly without requiring removal of the sash member.

Moreover, the cooperative engagement between the structural filler and the jamb liner substantially prevents lateral movement of the sash member when the member is engaged with the structural filler. In one option, the structural filler and the jamb liner cooperate to substantially prevent rotation of the structural filler in a second direction opposite to the first direction (e.g. into the jamb liner). Because the structural filler does not rotate in the second direction, the structural filler substantially prevents lateral movement of the sash member over the structural filler due to forces, such as severe winds. The structural filler, in one option, is engaged with the sash member over a long surface (e.g., a flange) and forces acting on the sash member are correspondingly distributed to the structural filler over a large area. The forces are then transmitted to the jamb liner and the jamb member. Because the structural filler absorbs the forces acting on the sash member, unwanted stress (e.g., point loading) is reduced at clutches, latches and the like that moveably couple the sash member to the jamb member.

Furthermore, the structural filler and the jamb liner cooperate so the structural filler couples along the jamb liner without additional fasteners or tools. The structural filler therefore presents a substantially uniform surface free of putty marks, fasteners and the like. The structural filler and the sash member include a similar material, in one option, to provide a consistent appealing appearance to the window or door. In one example, the structural filler includes wood and matches the wooden sash member and/or jamb member.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. A window or door assembly comprising:

a jamb member;

a jamb liner coupled along the jamb member, wherein the jamb liner includes a fastener opening;

a sash moveably coupled along the jamb liner; and a freely rotating structural filler coupled over a portion of the jamb liner and the fastener opening in an installed orientation, wherein the structural filler includes:

a base member;

a flange positioned near a first end of the base member adjacent to the sash, and the flange substantially prevents movement of the sash over the structural filler, a contact surface engaged with the jamb liner, and the contact surface is positioned near a second end of the base member remote from the sash, and the sash conceals the base member from the first end toward the flange, and the base member extends beyond the sash from the flange to the contact surface near the second end, a projection rotatably coupled with the jamb liner, and the structural filler freely rotates in a first direction around the projection after the structural filler is in the installed orientation, rotation of the structural filler in the first direction decouples the structural filler from the jamb liner and rotates the base member toward the sash, and the contact surface and the projection of the structural filler engage with the jamb liner in the installed orientation to prevent rotation of the structural filler in a second direction opposed to the first direction.

2. The window or door assembly of claim 1, wherein the flange extends along the structural filler and the sash.

3. The window or door assembly of claim 1, wherein the structural filler has a length and the structural filler and the jamb liner are adapted to transmit at least 6.0 pounds force per inch of structural filler length to the jamb member when the sash is engaged with the flange.

4. The window or door assembly of claim 1, wherein the base member has a substantially uniform outer surface between at least the flange and the contact surface.

5. The window or door assembly of claim 1, wherein the jamb liner and the jamb member are integral.

6. The window or door assembly of claim 1, further comprising a jamb stop coupled with the jamb member, wherein the jamb stop extends over a portion of the sash, and the jamb stop and the structural filler cooperate to retain the sash therebetween.

7. The window or door assembly of claim 1, further comprising a cladding coupled with the jamb member, wherein the cladding extends over a portion of the sash, and the cladding and the structural filler cooperate to retain the sash therebetween.

8. The window or door assembly of claim 1, wherein the structural filler includes a first material and the sash includes the first material.

9. The window or door assembly of claim 1, wherein the structural filler includes a first material and the jamb member includes the first material.

10. A window or door assembly comprising:

a jamb member;

a jamb liner coupled with the jamb member, the jamb liner extending along at least a portion of a jamb member length, wherein the jamb liner includes a first balance channel and a second balance channel;

a sash movably coupled along the jamb liner, the sash member near one of the first and second balance channels; and a structural filler coupled over a web between the first and second balance channels in a first installed orientation, the structural filler includes:

a base member positioned across the web, a pivot projection extending from the base member, the pivot projection is coupled within a filler recess of the jamb liner, the filler recess is at a first web side, a contact surface extending from the base member, the contact surface is coupled over a filler footing of the jamb liner, the filler footing is at a second web side, wherein the web is between the first and second web sides, a sash flange extending from the base member, the sash flange engaged with the sash, and wherein the structural filler is freely rotatable in a first direction relative to the jamb liner at the pivot projection, rotation of the structural filler in the first direction decouples the structural filler from the jamb liner, and coupling of the pivot projection within the filler recess and engagement of the contact surface over the filler footing locks the structural filler against rotation in a second direction opposed to the first direction and substantially prevents lateral movement of the sash past the sash flange in a direction coincident with the second direction.

11. The window or door assembly of claim 10, wherein the contact surface is snap-fit with the filler footing.

12. The window or door assembly of claim 10, wherein the jamb liner includes a ledge extending over the filler recess, and the pivot projection is retained beneath the ledge.

13. The window or door assembly of claim 10, wherein the sash flange extends along the structural filler and the sash.

14. The window or door assembly of claim 10, wherein the structural filler has a length and the structural filler and the jamb liner are adapted to transmit at least 6.0 pounds force per inch of structural filler length to the jamb member when the sash is engaged with the sash flange.

15. The window or door assembly of claim 10, wherein the structural filler has a substantially planar outer surface between at least the sash flange and the contact surface.

16. The window or door assembly of claim 10, wherein the jamb liner and the jamb member are integral.

17. The window or door assembly of claim 10, further comprising a jamb stop coupled with the jamb member, wherein the jamb stop extends over a portion of the sash, and the jamb stop and the structural filler cooperate to retain the sash therebetween.

18. The window or door assembly of claim 10, wherein the structural filler includes a first material and the sash includes the first material.

19. The window or door assembly of claim 10, wherein the web includes a fastener groove, and the structural filler conceals the fastener groove.

20. A window or door assembly comprising:

a jamb member;

a jamb liner coupled with the jamb member, the jamb liner extending along at least a portion of a jamb member length, the jamb liner including:

a fastener groove, wherein at least one fastener is positioned within the fastener groove and extends through the jamb liner into the jamb member, a first filler recess at a first fastener groove side, a second filler recess at a second fastener groove side, wherein the fastener is between the first and second fastener groove sides, a first filler footing at the first fastener groove side, and a second filler footing at the second fastener groove side;

at least one sash movably coupled along the jamb liner near one of the first fastener groove side and the second fastener groove side;

a structural filler detachably coupled with the jamb liner, the structural filler includes:

a pivot projection sized and shaped for coupling within one of the first filler recess and the second filler recess, a contact surface sized and shaped for coupling over one of the first filler footing and the second filler footing, and a sash flange engaged with the at least one sash; and wherein the pivot projection is coupled within the first filler recess and the contact surface is coupled over the second filler footing in a first structural filler position, the structural filler is rotatable in a first direction relative to the jamb liner at an intersection of the pivot projection and the first filler recess, and the pivot projection is reversibly coupled within the second filler recess and the contact surface is reversibly coupled over the first filler footing in a second structural filler position, and the structural filler is rotatable in a second direction relative to the jamb liner at an intersection of the pivot projection and the second filler recess, the second direction is opposed to the first direction.

21. The window or door assembly of claim 20, wherein the sash flange is engaged against the at least one sash in the first structural filler position where the at least one sash is near the first fastener groove side, and the sash flange is engaged against the at least one sash in the second structural filler position where the at least one sash is near the second fastener groove side.

22. The window or door assembly of claim 20, wherein coupling of the pivot projection within the first filler recess and coupling of the contact surface with the second filler footing in the first structural filler position substantially prevents lateral movement of the at least one sash past the sash flange toward the second filler footing.

23. The window or door assembly of claim 20, wherein coupling of the pivot projection within the second filler recess and coupling of the contact surface with the first filler footing in the second structural filler position substantially prevents lateral movement of the at least one sash past the sash flange toward the first filler footing.

24. The window or door assembly of claim 20, wherein the jamb liner includes a first weather strip groove near the first fastener groove side, and a second weather strip groove near the second fastener groove side.

25. The window or door assembly of claim 24 further comprising a weather strip assembly having a weather strip flange, the weather strip flange is coupled within one of the first and second weather strip grooves.

26. The window or door assembly of claim 20 further comprising a cladding coupled with the jamb member, wherein the cladding extends over a portion of the sash, and the cladding and the structural filler cooperate to retain the sash therebetween.

27. The window or door assembly of claim 20, wherein the structural filler includes a first material and the jamb member includes the first material.

* * * * *